United States Patent [19]

Gombas

[11] 4,402,202

[45] Sep. 6, 1983

[54] METHOD AND APPARATUS FOR ROLL FLANGING CONTAINER BODIES

[76] Inventor: Laszlo A. Gombas, Rte. 7, Box 555Q, Evergreen, Colo. 80439

[21] Appl. No.: 279,335

[22] Filed: Jul. 1, 1981

[51] Int. Cl.[3] ..... B21D 19/04

[52] U.S. Cl. ..... 72/94; 72/124; 72/126

[58] Field of Search ..... 72/94, 124, 125

[56] References Cited

U.S. PATENT DOCUMENTS

| | | | |
|---|---|---|---|
| 3,062,263 | 11/1962 | Austing et al. | 72/94 |
| 3,266,451 | 8/1966 | Kraus | 72/117 |
| 3,498,245 | 3/1970 | Hansson | 72/126 |
| 3,782,314 | 1/1974 | Franek et al. | 72/94 |
| 4,199,073 | 4/1980 | Gombas | 220/70 |

*Primary Examiner*—Lowell A. Larson
*Attorney, Agent, or Firm*—Kyle W. Rost

[57] ABSTRACT

A continuous rotary machine for roll flanging the ends of cylindrical container bodies transports the container bodies in a star wheel while applying a roll flanging tool head to the end portion of the container body in two stages. In the first stage, the tool head forms a small flange that acts as a stress ring to maintain the cylindrical body in circular configuration at the open end, and the stress ring is ironed. In the second stage, the tool head advances by a greater distance to form a larger portion of the flange, and this flange is ironed. Both ends of a cylindrical container body may be simultaneously flanged by this method, in which case the opposite flanging heads rotate in opposite directions at substantially the same speed. The rotary apparatus provides a spindle/ram assembly on a turret for supporting and moving the flanging heads. A cam operates the axially movable ram portion and is located radially outside the ram for greater accuracy in the cam profile. The turret is accurately maintained on a main shaft of the machine by a two rib supporting structure to assure radial alignment and by a locking key with expandable body in a keyway to assure axial alignment.

25 Claims, 10 Drawing Figures

METHOD AND APPARATUS FOR ROLL FLANGING CONTAINER BODIES

BACKGROUND OF THE INVENTION

1. Field of the Invention

The invention relates to making of sheet metal ware and specifically to the manufacture of cylindrical metal container bodies. Method and apparatus for flanging container bodies, especially cans, is disclosed.

2. Description of the Prior Art

Substantially all metal can bodies used in the food and beverage industry are flanged at the end portion of the cylindrical can body in preparation for seaming an end closure panel to the can body. Common techniques for flanging container body ends include die flanging and roll flanging. Die flanging requires that the container body be forced over a single large flanging die that simultaneously flanges the entire circumference of the container edge. Roll flanging involves the application of one or more orbiting rollers to the edge of the container body, wherein the rollers are each in contact with only a small portion of the circumference, but by repeatedly rotating the orbiting rollers around the end circumference, it is possible to form a uniform flange on the entire circumference.

Metal can bodies are being constructed from increasingly thin material with the result that the edge adjacent to an open end of the can body is much more subject to cracking during the flanging process than was true when thicker materials were used. Roll flanging has been found to be a more desirable method of flanging than die flanging due to its apparently better ability to avoid cracking the flange during formation.

Among generally desirable goals remains the further elimination of flange cracking. It is also generally desirable to increase the speed at which flanging can be accomplished. However, increased speed often results in higher reject rates for cracked flanges. At fast speed for present flanging machines in the beverage can manufacturing industry is approximately one hundred cans per minute per roll flanging head.

A further generally desirable goal is to improve the reliability of flanging machines by reducing maintenance requirements. Excessive wear between sliding parts of prior flanging machines may be the cause of unnecessary repair expense and down time. It is therefore desired that all moving machine parts be bearing-supported both to reduce maintenance expense and to assure that the accuracy of the machine remains at a high level.

These and other goals are achieved as described below.

SUMMARY OF THE INVENTION

In an apparatus for flanging a cylindrical metal container body at an edge adjacent to an open end thereof, a machine base carries a main shaft for relative rotation, and the main shaft in turn carries a container body transport means having pockets for carrying a cylindrical metal container in a position axially parallel to the axis of the main shaft. A flanging tool assembly is axially aligned with the pocket and carries a flanging roller radially offset from a central axis of rotation of the tool assembly, wherein the roller is adapted to flange a container body edge adjacent to an open end thereof by combined axial movement into an open end of the container body and rotational motion around the adjacent edge. A turret assembly is carried by the main shaft for synchronized rotation with the transport means and carries the flanging tool assembly for both axial motion parallel to the axis of the main shaft and rotational motion about the central axis of the flanging tool assembly, which is parallel to the main shaft and offset radially therefrom. A cam means is carried in substantially non-rotatably relationship to the machine base and is operatively connected to the turret assembly for imparting axial movement to the flanging tool assembly, wherein the cam means imparts axial movement in two discrete stages, the first stage including an axial advancement subsequent to the initial contact between the roller and container body edge, followed by a period of substantial non-advancement, and the second stage including a further axial advancement following the first stage period of substantial non-advancement, followed by a further period of substantial non-advancement. A means for imparting rotation to the flanging tool assembly about the central axis is also carried by the machine base in substantially non-rotatable relationship.

The cam means may include an annular cam with an axially facing cam contact surface spaced radially from the main shaft by a greater distance than the radial spacing of the flanging tool central axis from the main shaft. The turret may include a ram means carrying the flanging tool for axial motion, and the ram means may include both an axially movable portion and an axially non-movable portion. The axially movable portion is connected to a cam follower that extends radially therefrom and contacts the cam contact surface. This arrangement permits the cam to be more finely contoured than would be possible if the cam radius were substantially the same or smaller than the radius between the flanging tool central axis and the main shaft. Since the cam follower is operating on the ram means along a radial arm, the ram means is provided with stabilizing means such as one or more rollers on radial axes relative to the central axis of the flanging tool, which rollers are in rolling contact with a guide surface on one of the two ram portions while the rollers are attached to the other of the two ram portions. All such stabilizing rollers may be on axes lying in a plane perpendicular to the main shaft, with two of such rollers being on axes perpendicular to the axis of the cam follower and one roller on an axis parallel to the axis of the cam follower. The cam follower and three stabilizing rollers noted above may be symmetrically distributed about the central axis.

The means for imparting rotation to the flanging tool assembly may include a gear connected to the machine base in non-rotatable relationship. The turret assembly may include a pinion gear substantially on the central axis of the tool assembly and connected to transmit its rotation to the tool assembly. The pinion gear engages the gear on the machine base and is rotated orbitally around this gear as the main shaft rotates with respect to the machine base. The pinion gear is connected directly to a portion of the turret assembly that is axially non-movable with the ram means, which may include a ball nut carried by the turret assembly for rotation about an axis parallel to the flanging tool central axis and colinear therewith. A spindle carrying the flanging tool assembly includes a spindle shaft that is rotatable on the central tool axis and connected to a spline shaft engaged in the ball nut for rotation therewith due to the common engagement of the balls associated with the ball nut in common semi-cylindrical raceways. The spindle shaft may be carried for rotation in a housing that serves as the movable portion of the ram, and this spindle/ram housing may be carried for axial movement in a further housing or ram cartridge mounted on the turret for orbital rotation around the main shaft.

When two piece can bodies are being flanged, or when only one end of a can body is being flanged at a single operation, the pockets of the transport means or star wheel may support the cans against the force of an advancing, spinning roll flanging tool assembly. When both ends of a cylindrical can body are to be simultaneously flanged, the star wheel may support the can body between opposite roll flanging tool assemblies, turrets, cams, and rotation imparting means. So that the can body will require little if any attaching mechanism for retaining the can body in the star wheel pocket, the flanging tool assemblies are rotated in opposite directions on central axes at substantially the same speeds. The gear connected to the machine base at the opposite sides of the apparatus may be a central or bull gear at one side of the machine and a ring gear at the opposite side, whereby the pinion gear will orbit the outside surface of the bull gear and will orbit the inside surface of the ring gear. The pinion gear associated with the ring gear will then be of larger size than the pinion gear associated with the bull gear in order to synchronize rotational speeds of the opposite roll flanging heads being applied to the opposite ends of the same cylindrical container body. The opposite cams are also synchronized to assure the flanging heads advance in unison so that the container body will be equally engaged with each, and correspondingly, the heads can be withdrawn without requiring special restraining forces to be applied to the container body. The primary forces that maintain the container body in the pocket of the star wheel are the friction between the container body and the star wheel surfaces and the friction between the container body and a brush lining the outer circumference of the container body pathway in the star wheel pocket.

Precise synchronization is made possible between opposed flanging tool assemblies both by the precise mounting of the turret assemblies on the main shaft and by the adjustable mounting of the cam and bull or ring gear to the machine base. The turret assembly is mounted on the main shaft with close tolerances, and the possibility of wobble is substantially eliminated by the use of a pair of axially spaced annular ribs on the inside surface of the turret housing for direct contact with the main shaft. Further, the alignment of the turret housing on the main shaft may be established by a the use of a split locking key opened by a taper plug shared between a keyway in the main shaft and turret housing, whereby substantially all clearance between the key and the main shaft and turret housing is eliminated. The bull gear, ring gear and cams may be mounted on a trunion that is carried for rotation with respect to the main shaft, and the trunion is fixed to the machine base by mechanism permitting adjustment of the trunion by rotation about the main shaft. Thus, trunions at the opposite sides of the machine base may be aligned to assure that the cams operate the flanging tool assemblies in unison.

The method of the invention includes supporting a container body in axial alignment with a roll flanging tool head of known type; bringing the container body and tool head together along the container body axis by a first axial distance after initial contact while rotating the flanging head with respect to the container body to form a first stage flange ring that stresses the container body wall into a circle; ironing the first stage flange ring by rotation between the tool head and container body without substantial axial movement; further bringing the flanging tool and container body together by a second axial distance greater than the first axial distance while rotating the tool head with respect to the container body to form an enlarged flange ring; and ironing the enlarged flange ring by further relative rotation between the container body and tool head without substantial axia' movement.

Container bodies having both ends open are simultaneously flanged at both ends by application of a separate tool head to each end.

An object of the invention is to flange metal beverage and food cans at a high rate of speed and without excessive cracking of the flanges. By a two step flanging process with the flange formed during each step being ironed, it is possible to perform the flanging operation at a high speed and without over working the metal.

Another object of the invention is to create a machine in which all motions are bearing-supported, especially in the spindle/ram assembly where both axial motion and rotational motion are imparted to the tool head. These motions are isolated with separate bearing-supported structures by the use of a ball nut on a splined shaft, wherein the shaft is rotatable with the ball nut and axially movable on the balls contained between the ball nut and shaft.

Further, an object is to create a machine capable of a high degree of accuracy in its operations. The machine therefore includes an accurate means of mounting the turret on the main shaft for highly accurate radial and axial positioning, and a cam is provided with exceptionally large radius. Machine elements moved by the cam are stabilized against undesired forces.

DESCRIPTION OF THE PREFERRED EMBODIMENT

Figure 2:
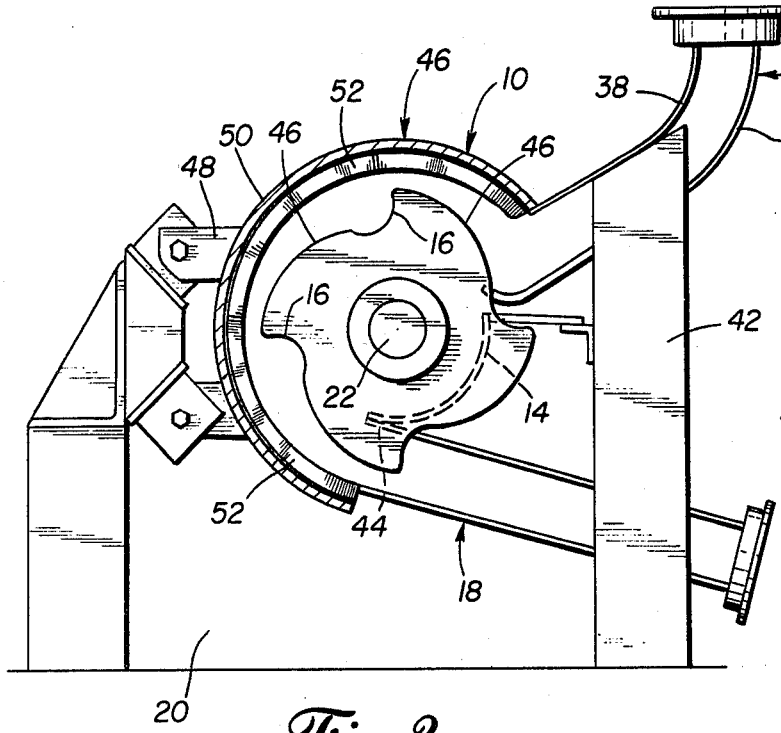
FIG. 2 is a vertical cross-sectional view taken approximately through the center of the machine and transversely to the main shaft, showing the star wheel and container pathway.

With reference to FIG. 2, the roll flanging machine 10 is of the continuous action rotary type wherein a supply of cylindrical container bodies (not shown) is fed to the machine by way of a suitable means such as infeed track assembly 12. The container bodies are received in a continuously rotating star wheel 14 having container receiving pockets 16 formed about its circumferential contours. The container bodies are carried along a pathway defined by the rotational path of the pockets 16, during which travel the machine 10 acts upon the container bodies to cause the axial end or ends thereof to become flanged. Each container body encounters the unloading track assembly 18 after the completion of the flanging operation and is removed from the star wheel and directed out of the machine 10 at this point.

The flanging machine 10 is intended for use with container bodies requiring a flange on both axial ends. This type of container body is often formed with a welded seam. The ends are flanged prior to application of closure panels. With modification, the machine 10 is adaptable to use in flanging the single end of a cup shaped container body, which usually is formed without any side seam. The former type of container is often referred to as a "three piece can" while the latter type is referred to as a "two piece can." The machine is described and illustrated primarily for use with three piece cans wherein both axial ends are simultaneously flanged.

Figure 1:
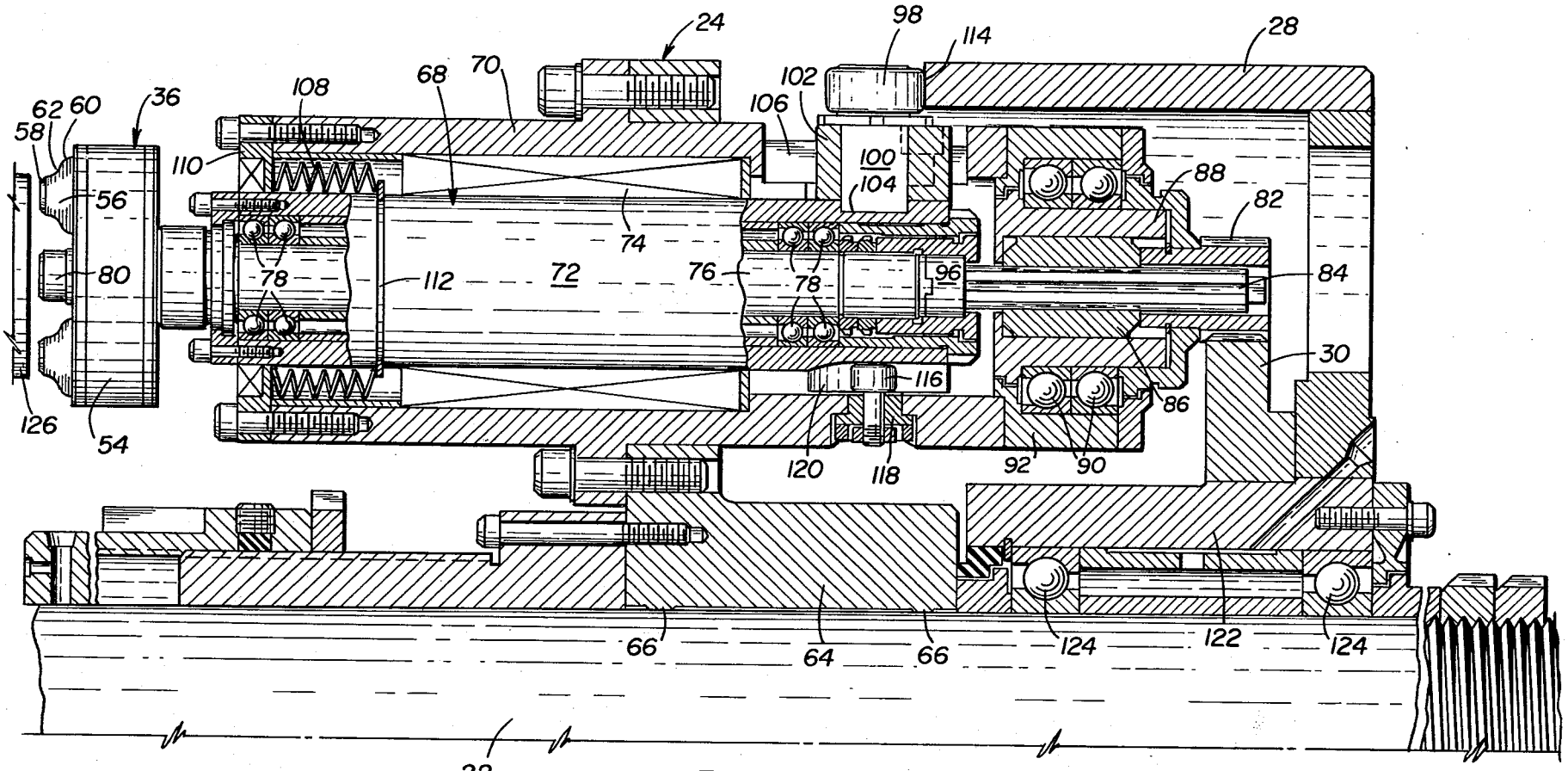
FIG. 1 is a vertical cross-sectional view of the flanging machine taken through one ram cartridge on one side of the machine and of the top half from approximately the center line of the main shaft.
Figure 3:
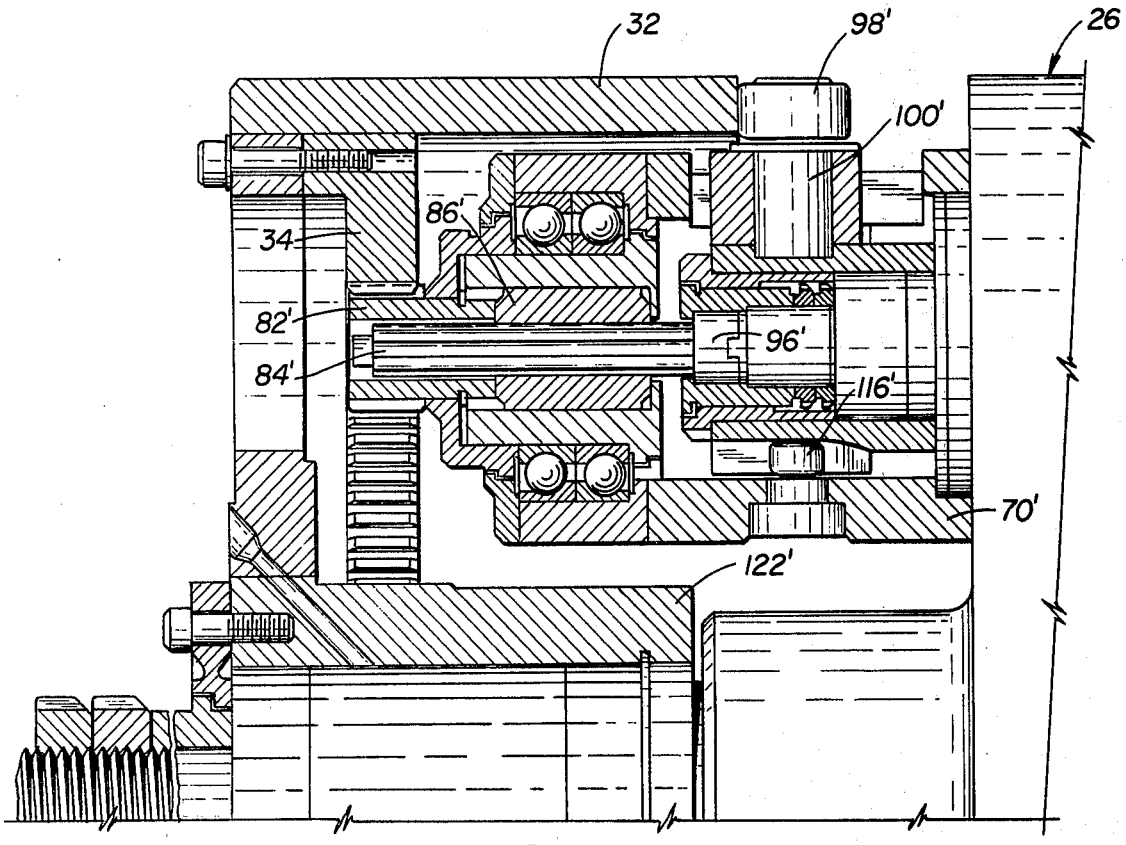
FIG. 3 is a view similar to FIG. 1, but limited to the cam and ring gear area at the opposite side of the machine.
Figure 8:
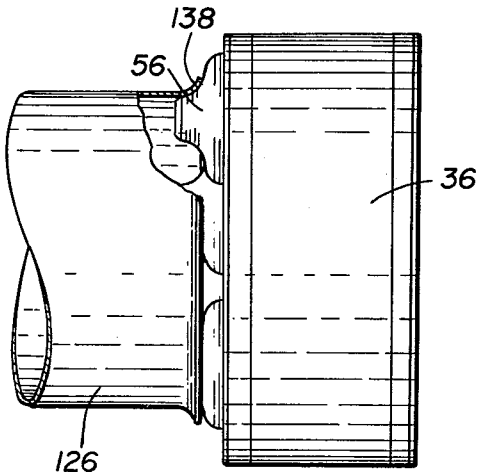
FIG. 8 is a view similar to FIG. 6, showing stage two flanging.
Figure 7:
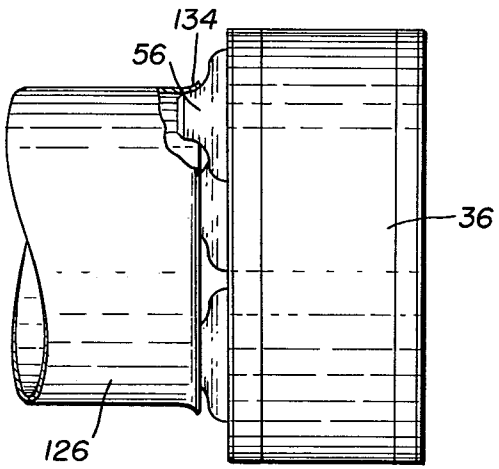
FIG. 7 is a view similar to FIG. 6, showing the completion of stage one flanging.

The major components of the flanging machine 10 are shown in FIGS. 1 and 2, wherein a machine base 20 carries a main shaft 22 for relative rotation, such as in pillow blocks or bearings. As is known, the main shaft is powered for rotation by a suitable motor, usually through an intermediate speed reducer. All machine components are then attached to either the base or the main shaft, depending upon the desired relationship with respect to rotation between such parts. The star wheel 14 may be viewed as being the approximate center of the machine, dividing the remaining portions of the machine into right and left halves. The right side turret assembly 24 shown in FIG. 1 is connected for rotation with the main shaft, and a left side turret assembly 26 shown in FIG. 3 is connected to the main shaft on the opposite side of the star wheel. Because the two turret assemblies are similar in construction, the right side turret assembly will be described in detail, while similar parts on the left side turret assembly will be given identical numbers with an added prime symbol. The right side of the machine includes a cam 28 and a bull gear 30, while the left side has a cam 32 and ring gear 34. The ring gear, bull gear, and both cams are connected to the machine base. The bull gear and ring gear interact with components carried on the turret assemblies to provide rotation to the roll flanging tool assembly 36 carried in axial alignment with each star wheel pocket, while the cams interact with components carried on the turret assemblies to provide axial motion to the roll flanging tools.

The general operation of the roll flanging machine with a supply of three piece can bodies supplied through infeed track assembly 12 is that each can body is received in a star wheel pocket 16, after which the can body is flanged at each end simultaneously in a two stage process. While the bull gear 30 and ring rear 34 cause the respective roll flanging tool assemblies on each side of the can body in a pocket 16 of the star wheel to rotate on an axis parallel to and orbiting the main shaft, the cams 28 and 32 advance the tool assemblies toward the can body. In the first stage flanging operation, the tool assemblies encounter the cylindrical side wall of the can body and apply a gradual flanging force, eventually forming a small flange or stress ring in the end portions of the cylinder. This ring is ironed and then provides a positive stiffening that tends to retain the cylindrical can body end in a circle. The second stage of the flanging process then takes place, as the flanging tool assemblies further advance toward the can body and apply relatively stronger flanging forces to the opposite ends of the can body. The previously formed stress ring supports the circular configuration of the can body to permit such stronger flanging action as the initial small flange is substantially enlarged. Upon completion of the flanging process, the flanging tool assemblies are withdrawn from the can body, and the now flanged can bodies are removed from the star wheel at the unloading track assembly.

Turning now to details of machine construction, the container body pathway is best shown in FIG. 2. The infeed track assembly 12 is formed from top rail 38, bottom rail 40, and suitable side panels for guiding the can bodies accurately toward the star wheel. The bottom rail is appropriately curved to introduce the can body to the star wheel pocket. Brackets 42 support the infeed track from the machine base. Star wheel 14 is attached to the main shaft 22 for rotation therewith. This wheel is preferred to be of the double plate type wherein the plates may be designated as the right side plate and the left side plate, each plate supporting the can body near an opposite axial end thereof. The space between the right and left plates permits the lower rail of the infeed track to enter and deliver a can body to each pocket with smoothness. Similarly, the unloading track includes an unloading ramp insert 44 located in the area between the star wheel plates, permitting the flanged can bodies to be positively removed from the pockets 16. The star wheel 14 is shown to be a four pocket wheel, wherein each pocket is sized to receive a can body having radius similar to the radius of the pocket. A ramp area 46 interconnects pockets 16. Between the infeed and unloading tracks and circumferentially enclosing the star wheel is a brush assembly 46 connected to the machine base, such as by suitable support brackets 48. The brush assembly includes brush holders 50 and brushes 52. The brushes cooperate with the star wheel pockets to retain the container bodies in the desired pathway between the infeed and unloading tracks. At the same time, the brushes and star wheel pockets do not scratch any decorative finish that may have been applied to the outer surface of the container body. More importantly, the brushes and star wheel pockets will permit the container body to slide axially, toward the right or left side of the machine, as may be required in order to balance the forces applied to the container body during the double ended flanging process.

The turret assemblies 24 and 26 each carry flanging tool assemblies 36 in number equal to the number of pockets 16 in the star wheel. A pair of flanging tool assemblies consisting of the right and a left side tool assembly are axially aligned with each pocket. Each tool assembly may include a housing 54 carrying a plurality of flanging rollers 56 rotatably mounted therein on axes parallel to the main shaft 22 as well as to the central rotational axis of the housing itself. The small rollers 56 are evenly spaced about the central rotational axis of the housing, with the exact spacing being determined by the diamater of the container body with which the flanging tool assembly is designed for use. Each flanging roller has a nose portion 58 of smaller diameter than a base portion 60, and a flanging curve 62 interconnects the nose and base and also determines the profile imparted to the flange formed on the ends of the container. A variety of roll flanging tool assemblies of this general type are commercially available.

In order to maintain high quality flanging action, the flanging tool assemblies are carried for minimum deviation from the desired alignment with the star wheel pockets. Thus, the turret assemblies are mounted on the main shaft with high precision. Each turret assembly includes a turret housing 64 carried on the main shaft by a pair of axially spaced, radially inwardly extending support ribs 66 that circumferentially rest upon the main shaft outer surface. The ribs may be formed with high accuracy such that there is substantially zero clearance with the shaft, while the relatively small surface area of contact between the shaft and the ribs permits the turret housing to be installed on the shaft within acceptable force levels. The two point support established by the ribs 66 provides predictable level alignment between the shaft and the housing 64.

The flanging tool assemblies are each carried from the turret housings on a spindle/ram assembly 68, which is carried in a ram cartridge 70 connected to the turret housing. Each spindle/ram assembly includes a spindle housing 72 carried non-rotatably with respect to the turret housing, for example on linear bearings 74 between the spindle housing and turret housing. A spindle shaft 76 is carried for relative rotation with respect to the spindle housing, for example on bearings 78. The inner end of the spindle shaft is adapted to connect to a roll flanging tool assembly 36, such as by use of a cap screw 80 engaged in a suitable threaded bore in the end of the shaft 76. The cap screw or other fastener may be suitably threaded with either right hand or left hand thread, as is appropriate for the direction of rotation to be imparted to the shaft 76 and tool assembly 36. To assure that the flanging tool assembly does not rotate with respect to the spindle shaft, the connection between these two parts may further include an antirotation device such as an interconnecting dowel pin offset from the central axis of the shaft. The use of such an antirotation device makes optional the use of specially selected screw thread direction.

Figure 4:
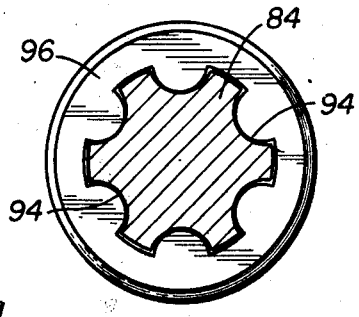
FIG. 4 is a cross-sectional view taken through the splined shaft from the right side of FIG. 1.

Relative rotation between the spindle shaft and spindle housing is created by the interaction of bull gear 30 and pinion gear 82 as the main shaft rotates with respect to the base. The pinion gear orbits the bull gear, which is non-rotatable with respect to the base, causing the pinion gear to rotate on the same axis as spindle shaft 76. The rotation of the pinion gear is transmitted to the spindle shaft through means for isolating the pinion gear from axial motion, such means including a spline shaft 84, ball nut 86, and ball nut cartridge 88. The pinion gear transmits its rotational motion directly to the ball nut and ball nut cartridge, which are non-rotatably joined. The ball nut cartridge, however, is connected to the ram cartridge for relative rotation about the axis of the spindle shaft. For example, the ball nut cartridge may be connected to bearings 90 having bearing races 92 mounted to the outer end of the ram cartridge. The spline shaft, shown in FIG. 4, shares axial splines 94, which constitute half of axially extending ball bearing raceways, with similar splines in the ball nut 86. The spline shaft and ball nut are relatively non-rotatable with respect to each other because of the presence of ball bearings in the spline raceways, but the spline shaft is capable of axial motion with respect to the ball nut. Spline coupling 96, FIG. 4, engages the splines 94 near the inner end of the spline shaft and also engages the outer end of the spindle shaft in a non-rotatable manner so that the spline shaft and spindle shaft will rotate in unison.

Axial mo'ion of the spindle/ram assembly is created by the interaction of the cam 28 and cam follower 98. The cam is non-rotatably connected to the base 20, while the cam follower is non-rotatably connected to the spindle housing 72, which also serves as the ram housing. Thus, the cam follower orbits the main shaft with the ram cartridge and follows axial variations in the cam contour. The cam follower hub 100 is slightly eccentric to permit fine adjustment of the ram housing position with respect to the cam. Hub 100 is connected to the housing 72 by a cam follower holder 102 as well as by a socketed engagement between the radially inner end of hub 100 and recess 104 in the housing wall. The ram cartridge defines an axial slot 106 in which the cam follower and holder 102 are free to move. The spindle housing 72 and cam follower are biased toward the cam by resilient means such as dish spring washers 108, which are retained and compressed between inner end retainer ring 110 near the inner end of the ram cartridge and outer end retainer ring 112 on the spindle housing.

It is notable that the cam 28 and cam follower 98 are positioned at a greater radius from the main shaft than is the spindle shaft 76. The cam is thus permitted to have a relatively larger operational surface area and longer cam path than would be possible in the conventional arrangement wherein the cam is at the same radius as the shaft that it moves. The cam operating surfaces 114, by virtue of its larger radius, can be contoured with greater accuracy and for higher precision in controlling the movement of the housing 72 than would be possible with a relatively smaller cam radius.

Because cam follower 98 operates against the cam at a position radially offset from the axis of shaft 76, a number of forces are generated in addition to the axial displacement force that is desired. For example, the friction between the cam follower and cam generates a rotational force about the axis of shaft 76, and the distance by which the cam follower is offset from the axis of shaft 76 serves as a moment arm to apply a bending force to shaft 76 substantially in the plane through the shaft and the cam follower. The tendency of these unwanted forces to contribute inaccuracy to the movement of the roll flanger tool assembly is offset by stabilizing means acting between the ram cartridge 70 and spindle housing 72. The stabilizing means may include one or more guide rollers such as cam follower roller 116 connected to either the cartridge 70 or housing 72 and operating against a guide surface on the other. For example, the roller 116 is carried in an eccentric holder 118 mounted in a bore through the ram cartridge wall and lying in a common diametric plane with cam follower 98. The roller 116 is engaged between a pair of axially extending walls 120 on the spindle housing. It is preferred that three such rollers 116 be employed with each ram cartridge, one being substantially opposite from and coaxial with the cam follower 98 and the other two being at opposite sides of the ram cartridge on an axis perpendicular to that of cam follower 98. The two side rollers resist the bending moment applied through cam follower 98, while all three rollers resist the rotational moment applied by the interaction of cam follower 98 against the cam.

The isolation of the ram motion from the rotational motion within the spindle/ram assembly 68 is evident, as the axial ram motion induced by the cam is transmitted directly to the spindle housing via the cam follower 98. The spindle housing and its contained spindle shaft move axially on linear bearings 74 to advance and retract the roll flanger tool assembly 36. Spline shaft 84 moves axially with the spindle shaft and rides on the ball bearings rotationally locking the spline shaft to the ball nut 86, which is not free to move axially. Thus, all axial ram motion is bearing-supported and does not involve frictional sliding between meshing gears. Rotational motion induced through pinion gear 82 is transmitted via the ball nut to the spline shaft as previously explained, causing the spline shaft to rotate with the ball nut and spindle shaft, all of which are bearing-supported.

The cam 28 and bull gear 30 are considered to be stationary with respect to base 20. Both components may be mounted on trunion 122, which is connected to the base and is also supported on the main shaft by bearings 124. The connection between the trunion 122 and the base may be through a tie rod of adjustable length, which is a known means of permitting small adjustment in the rotational position of the cam 28 for synchronization of the cam positions between the right and left sides of the roll flanging machine. With reference to FIG. 3, the bull gear is replaced by ring gear 34, attached with cam 32 to trunion 122', which may also be connected to the base by an adjustable connection. Because the ring gear has a larger radius than the bull gear, pinion gear 82' may be larger than pinion gear 82 so that the rotational speeds imparted to the roll flanger tool assemblies on the right and left sides of the machine will be approximately equal.

Figure 5:
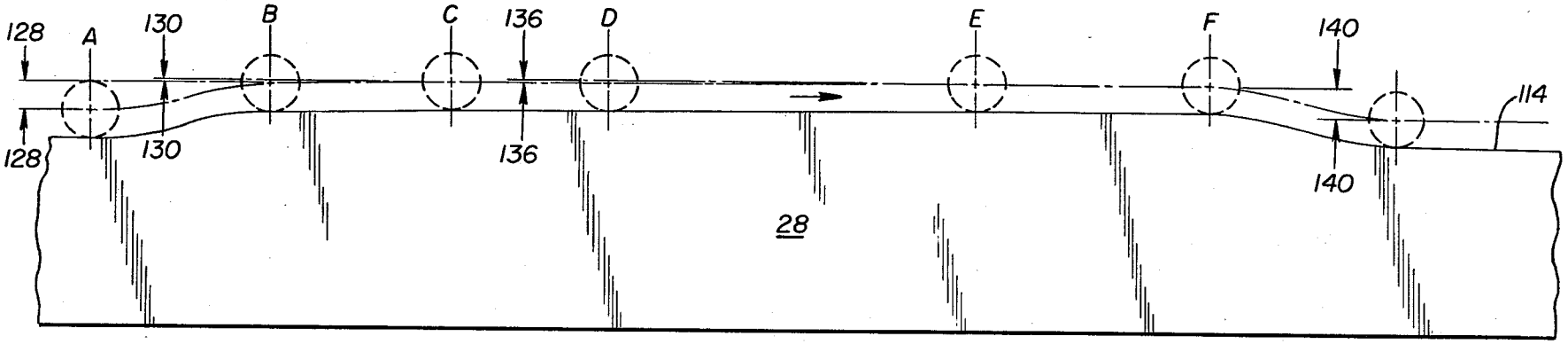
FIG. 5 is a developmental view of the cam profile, with the positions of the cam follower shown in phantom and with important variations of the profile indicated by spacing lines.

The detailed operation of the flanging tool is best shown in FIGS. 5–8, where it will be assumed that a container body 126 enters the pocket 116 of the star wheel and is carried through an arc of approximately 213 degrees before being unloaded. FIG. 5 shows the contour of cam 28 at face 114 as the cam follower 98 moves a total axial distance of 0.600 inches, which will be presumed to be an appropriate total axial travel for the flanging tool assembly when the can 126 is a twelve ounce beverage container. It should be remembered that for a three piece can body, the opposite end of the body 126 is being simultaneously flanged by another flanging tool assembly being moved axially by matching cam 32.

Figure 6:
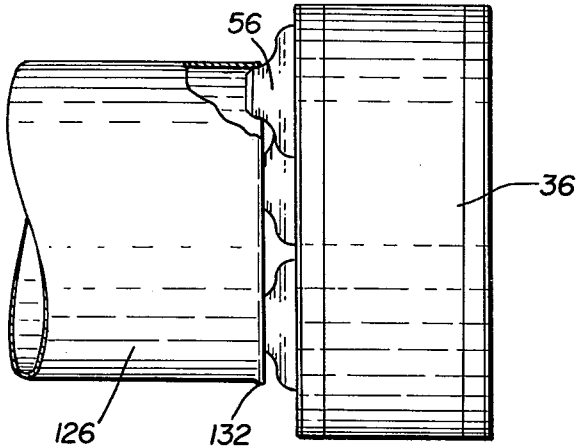
FIG. 6 is a fragmentary side elevational view of a container body being engaged by a flanging tool assembly during stage one flanging.

The point at which the can body has entered the star wheel pocket is designated as point A, at which time the cam follower 98 is fully retracted. During arc A-B, which may be thirty degrees, the cam follower advances the flanging tool to the point of contact with the edge of the can body, which may be an advance of 0.527 inches as represented between arrows 128. First stage flanging takes place in the arc B-C, which may be thirty degrees. The cam follower and flanging tool here are advanced by a small distance 130 such as 0.025 inches. FIG. 6 shows the preliminary flanging taking place during arc B-C as the can body wall tends to form chords between the rollers 56. Through the slow advance of the tool 36 into the container body, the chording eventually gives way to the slight flanging shown at 132. In the next arc, C-D, which may be twenty-five degrees, the cam follower and tool 36 maintain the position of advancement achieved in the previous arc B-C and the tool irons the flange to more fully establish a stress ring 134 shown in FIG. 7. The stress ring 134 provides sufficient rigidity to the circular configuration of the container body end opening that chording between rollers 56 is substantially reduced or eliminated.

Second stage flanging takes place after the formation of the stress ring 134. Through arc D-E, which may be sixty degrees, the cam follower and flanging tool are advanced by a greater distance than in the first stage of flanging. For example, the advancement may be 0.048 inches, as represented between arrows 136. Second stage ironing takes place in the following arc E-F, which may be thirty-eight degrees. FIG. 18 shows the formation of a full flange 138 as would exist at point F. In arc F-G, the cam follower and flanging tool are retracted by the full advancement of 0.600 inches as represented between arrows 140. At the conclusion of this arc, which may be thirty degrees, the container body is free of the flanging tools and may be unloaded from the machine. The cam follower and flanging tool remain in fully retracted position through the arc G-A, which may be one hundred forty seven degrees, permitting the next container body to be loaded into the star wheel pocket.

Accordingly to accepted standards for flanges on beverage containers, the fully formed flange 138 includes an arc of ninety degrees and has a radius of 0.080 inches. Other types of flanges have been proposed, including a much smaller flange. The method of operation employed with the roll flanging machine 10 may be applied to such other flanges as well. The first stage of flanging will involve an axial advance of the flanging tool of about one-third or between 30% and 38% of the total axial travel during active flanging, while the second stage of flanging will involve an axial travel of about two-thirds or between 60% and 72% of the total axial travel during active flanging.

The number of flanging rollers 56 on the flanging tool assembly and the number of rotations of the tool assembly on its central axis also contribute to the rapid formation of a high quality flange. A flanging tool assembly 36 may have as few as one roller 56, although a larger number such as three to six such rollers is common. Each point on the end portion of the cylindrical container body is subjected to repeat application of roller forces, either by repeated application of a single roller or by one or more applications of a series of rollers. In the example given above, each point on the container edge is subjected to from three to five roller applications during first stage flanging, with the result that each roller application produces from approximately twenty percent to thirty-three percent of the first stage flanging as measured by axial advance of the tool head. During second stage flanging, each roller accomplishes from approximately eleven to seventeen percent of the flanging, requiring from six to nine roller applications. First stage ironing may involve from two to four roller applications, while second stage ironing may involve from four to six roller applications. An excessive number of roller applications is undesirable, as the metal flange is hardened and crystalized.

Among the advantages of the machine 10 as thus described is that the container body is free to move axially between the right and left side flanging heads as required. Flanging forces increase with the increased degree of flange, so that the container body 126 tends to be self-centering between the flanging tools at its opposite axial ends to assure that an equal flange is formed at each end thereof. There is no necessity to apply strong holding forces to the container body either to limit axial movement or to limit rotation. The flanging tool themselves provide the necessary limitation on axial movement, and the tendency for the cans to rotate on their own axes is minimized by the opposite direction of rotation of the flanging tools at the opposite ends of the container body, which is the result of having the bull gear provide rotation to one of the tools while the ring gear provides rotation to the other.

Figure 9:
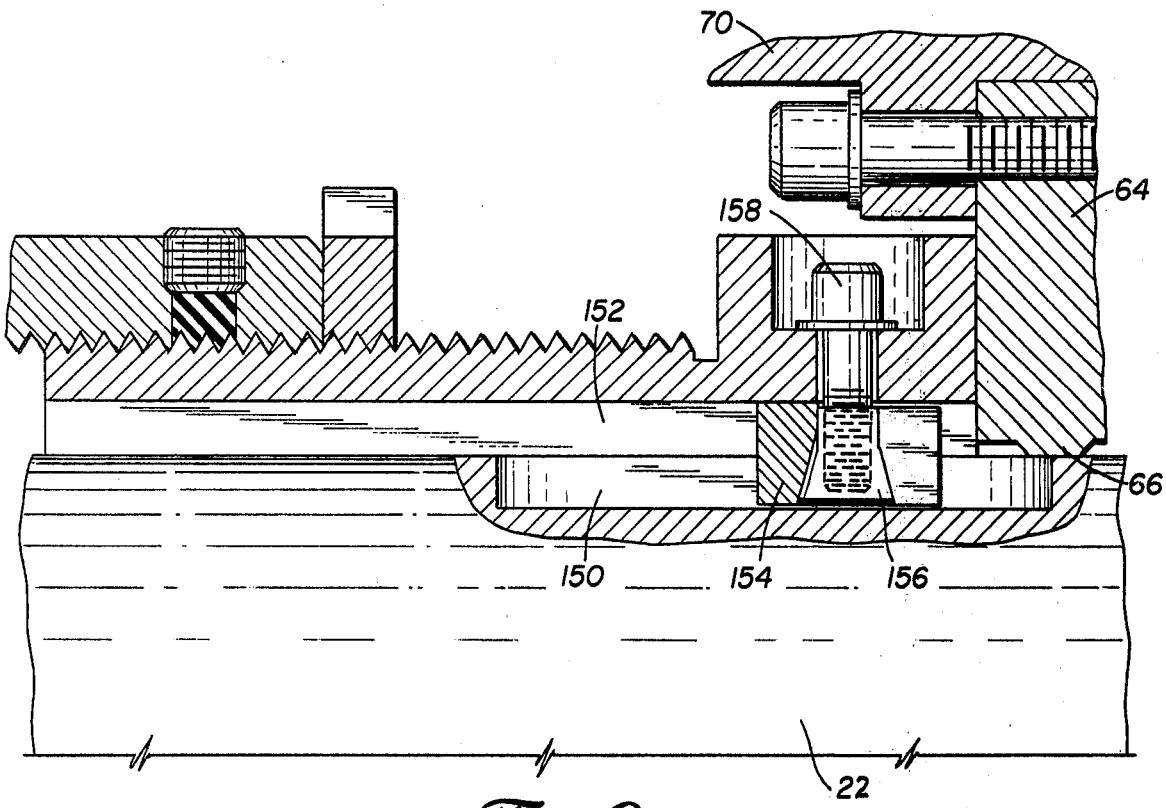
FIG. 9 is an enlarged fragmentary cross-sectional view of the mounting of the turret assembly on the main shaft, showing a locking key.
Figure 10:
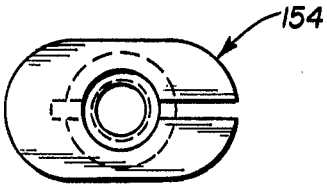
FIG. 10 is a top plan view of the locking key body with the taper plug in place.

The right and left side flanging heads are timed to operate in unison during initial advancement, first and second stages of flanging, and retraction so that both flanging heads will complete work on a single container body at substantially the same instant, thereby providing further equality between forces on the opposite ends of a container body. The exact timing is achieved in part by the selective positioning of the trunions 122 and 122' with respect to each other in angular relationship on the axis of the main shaft, as previously explained. Another aspect of exact timing is the precise fit between the turrets and the main shaft with respect to angular position. While it is common to fit a turret housing to a shaft by use of a keyway and axially extending key, the key is required to have a clearance with the keyway slot and turret housing, thereby creating a potential for the turret housing and main shaft to have a slight variation in relative angular position. With reference to FIGS. 9 and 10, a means is provided to key the turret housing to the main shaft with elimination of substantially all potential for angular variation. The main shaft 22 has a keyway slot 150 extending axially from the surface of the shaft, and the turret housing 64 is connected to a bushing having an overlapping axial slot 152. Locking key body 154 is sized to be engaged in both slots 150 and 152. As best shown in FIG. 10, the locking key body is elongated in the axial direction so as to be non-rotatable in the keyway slots, and the body is provided with a split side to permit expansion against the sides of the keyways. A taper plug 156 is engaged in a bore having a downwardly flaring bottom portion and communicating with the split side. A threaded fastener such as cap screw 158 engages the taper plug through the top of the bore. The locking key is engaged in slots 150 and 152 with the taper plug engaged in the flare of the bore, after which the fastener 158 is inserted through the top of the bore via a suitable access hole in the bushing or other machine part to be mounted on the main shaft. The threaded fastener draws the taper plug into the flare of the bore, widening the locking key body at the split side and thereby locking the slots 150 and 152 into axial alignment having substantially no clearance for angular movement about the axis of the main shaft. The use of such a locking key is not limited to the roll flanging machine 10 but is applicable to the mounting of any type of machine part on a key slot.

I claim:

1. Apparatus for flanging a cylindrical metal container body at an edge adjacent to an open end thereof, comprising:

a machine base;

a main shaft carried by said machine base for relative rotation with respect thereto;

a container body transport means carried by said main shaft for rotation therewith and having a pocket for carrying a cylindrical metal container with its axis parallel to the axis of the main shaft;

a flanging tool assembly axially aligned with said pocket and carrying a flanging roller radially offset from a central axis of the tool assembly, wherein said roller is adapted to flange a container body edge adjacent to an open end thereof by combined axial movement into said open end and rotational motion around the adjacent edge;

a turret a sembly carried by said main shaft for rotation therewith and carrying said flanging tool assembly for axial motion parallel to the axis of the main shaft and for rotational motion about said central axis of the flanging tool assembly, wherein said central axis is parallel to the axis of the main shaft and radially offset therefrom;

a cam means carried by said machine base and substantially non-rotatable with respect thereto, wherein the cam means is operatively connected to the turret assembly for imparting axial movement to said flanging tool assembly, said cam means being adapted for imparting at least two discrete stages of axial advancement to the flanging tool assembly, wherein the first stage includes an axial advancement subsequent to, in use, initial contact between the flanging roller and the container body edge, followed by a period of substantial non-advancement, and the second stage includes a further axial advancement following the first stage period of substantial non-advancement, followed by a further period of substantial non-advancement; and means for imparting rotation to said flanging tool assembly about said central axis.

2. The apparatus of claim 1, wherein said cam means comprises an annular cam having an axial facing cam contact surface spaced radially from the main shaft at a relatively greater distance than the radial distance to said central axis of the flanging tool assembly.

3. The apparatus of claim 2, wherein said turret assembly comprises a ram means carrying said flanging tool assembly for axial movement with respect to said main shaft, the ram means comprising a non-axially movable portion and an axially movable portion; and further comprising a cam follower connected to said axially movable portion and extending radially outwardly therefrom for contact with said cam contact surface.

4. The apparatus of claim 3, further comprising stabilizing means for resisting rotational and bending forces applied to said axial movable ram means portion through said cam follower.

5. The apparatus of claim 4, wherein said stabilizing means comprises at least one roller on an axis of rotation radially perpendicular to the axis of said axially movable ram means portion and a guide surface engaged by said roller and extending axially parallel and radially spaced from the axis of the axially movable ram means portion, said stabilizing roller and guide surface being connected to separate ram means portions for axial movement therebetween.

6. The apparatus of claim 5, wherein said stabilizing means comprises at least two said rollers and guide surfaces, wherein the rollers are on axes lying in a plane radial to the main shaft and perpendicular to the axis of said cam follower.

7. The apparatus of claim 1, wherein said means for imparting rotation to the flanging tool assembly comprises gear means connected to said machine base and substantially non-rotatable with respect thereto, and the turret assembly comprises a pinion gear engaging said gear means and connected to said flanging tool assembly for imparting rotation to the flanging tool assembly in response to relative rotation between said main shaft and machine base; wherein the connection between the pinion gear and flanging tool assembly comprises: a spline shaft connected for rotation with the flanging tool assembly about said central axis; a ball nut engaging said spline shaft for relative axial movement on said central axis therebetween and for rotation therewith; and wherein said pinion gear is connected to the ball nut and the ball nut is carried by said turret assembly for rotation about said central axis.

8. The apparatus of claim 1, adapted for simultaneous flanging of both edges of a cylindrical metal container body having opposite open ends, wherein a flanging tool assembly and turret assembly are axially aligned with each axial end of said container body transport means pocket; substantially identical synchronized cam means are carried by the machine base in operative connection with each of said turret assemblies; and wherein said means for imparting rotation to the flanging tool assemblies comprises a central gear connected to the machine base on a first side of the pocket and a ring gear connected to the machine base on a second side of the pocket, each of said gears being operatively connected to one of said turret assemblies for imparting opposite rotation to the flanging tool assemblies about said central axis.

9. The apparatus of claim 8, wherein each of said turret assemblies comprises a pinion gear of predetermined diameter connected to the flanging tool assembly of the same turret assembly for imparting rotation to the flanging tool assembly in response to relative rotation between said main shaft and machine base, wherein the first pinion gear on the first side of the pocket engages said central gear, the second pinion gear on the second side of the pocket engages the ring gear, both of said pinion gears are carried by their respective turret assemblies at substantially equal radial distances from the main shaft, and the predetermined diameter of the second pinion gear is relatively larger than the predetermined diameter of the first pinion gear for substantially equalizing the rotational speed of the first and second pinion gears against, respectively, the central and ring gears.

10. The apparatus of claim 1, wherein said turret assembly comprises a central housing defining an opening for receipt of said main shaft therethrough, the central housing defining at least two axially separated circumferential ribs extending radially inwardly to said opening for supporting contact with the main shaft.

11. The apparatus of claim 1, wherein said turret assembly and main shaft define overlapping facing keyway slots, and further comprising: a locking key at least partially receivable in both of said keyway slots and defining a substantially radial bore with a flared bore portion, wherein the locking key is split on at least one side of the bore; a taper plug at least partially receivable in the flared bore portion and adapted to laterally expand the locking key at said split side when further received in the flared bore portion; and a threaded fastener receivable in said bore and engaged with said taper plug for drawing the taper plug into expanding engagement with the locking key.

12. The apparatus of claim 1, wherein said cam means is adapted to impart a greater axial advancement to the flanging tool assembly during second stage advancement than during first stage advancement.

13. The apparatus of claim 12, wherein said cam means is adapted to impart approximately one-third of the tool axial advancement of the first and second stages of advancement during the first stage.

14. The apparatus of claim 12, wherein said cam means is adapted to impart approximately between sixty and seventy-two percent of the total axial advancement of the first and second stages of advancement during the second stage.

15. The apparatus of claim 1, wherein said rotation imparting means is adapted to rotate the flanging tool assembly to cause approximately from three to five flanging roller applications to the edge of the container body during first stage advancement.

16. The apparatus of claim 1, wherein said rotation imparting means is adapted to rotate the flanging tool assembly to cause approximately from two to four flanging roller applications to the edge of the container body during first stage substantial non-advancement.

17. The apparatus of claim 1, wherein said rotation imparting means is adapted to rotate the flanging tool assembly to cause approximately from six to nine flanging roller applications to the edge of the container body during second stage advancement.

18. The apparatus of claim 1, wherein said rotation imparting means is adapted to rotate the flanging tool assembly to cause approximately from four to six flanging roller applications to the edge of the container body during second stage substantial non-advancement.

19. Apparatus for flanging the edge of a cylindrical metal container body adjacent to an open end thereof, comprising:

a machine base;

a main shaft mounted for rotation on said base about the longitudinal axis of the shaft;

a star wheel connected to said main shaft for rotation therewith with respect to said machine base, wherein the star wheel has a plurality of pockets adapted to receive, in use, cylindrical metal container bodies and carry such container bodies with the rotation of the wheel, the axis of th cylindrical bodies being parallel to the axis of the main shaft;

a turret assembly connected to said main shaft for rotation therewith, wherein the turret assembly carries a plurality of ram cartridges in like number to said star wheel pockets, each said ram cartrige being axially aligned with a star wheel pocket and entirely carrying for axial movement along said axis of alignment a ram housing, said ram housing entirely carrying for rotation on said axis of alignment a spindle shaft;

a flanging tool assembly carried on said spindle shaft for rotation about said axis of alignment and including at least one flanging roller rotatable about a roller axis parallel to the axis of alignment and radially offset therefrom for rolling contact, in use, with the inside of the cylindrical container edge;

an annular cam carried by said machine base for permitting relative rotation of the main shaft with respect thereto and contacting said turret assembly for guiding the axial movement of said ram housing;

a machine base mounted gear carried symmetrically with respect to the main shaft axis;

a pinion gear carried by each of said ram cartridges in operative contact with said machine base mounted gear for inducing rotation of the pinion gear in response to rotation of said main shaft; and means for transmitting the rotation of the pinion gear to said spindle shaft while isolating the pinion gear from axial movement of the ram housing.

20. The apparatus of claim 19, wherein said means for transmitting rotation of the pinion gear comprises a ball nut entirely carried by said ram cartridge for relative rotation with respect thereto about said axis of alignment, the pinion gear being connected to the ball nut for rotation therewith on the axis of alignment; and a spline shaft engaged for rotation with the ball nut on the axis of alignment and for axial movement with respect to the ball nut; wherein the spline shaft is coaxially connected to said spindle shaft for rotation therewith.

21. The method of flanging an open end of a cylindrical metal container body, comprising:

supporting said cylindrical body with the open end thereof facing a roll flanging tool of the type having a body supporting at least one flanging roller of smaller diameter than the open end of the container body and offset radially from the central axis of the container body for contacting the inside wall of the container body, wherein the container body and tool body are supported for relative rotation on the axis of the container body;

moving the flanging tool and container body relatively together along said axis by a first axial distance beyond initial contact between the flanging roller and container body wall while relatively rotating the flanging tool with respect to the container body to form an initial flange ring for stressing the wall against deformation from a circle;

ironing the flange ring by relative rotation between the container body and flanging tool without substantial axial advancement between the container body and flanging tool;

further advancing together the flanging tool and container body by a second axial distance relatively greater than said first axial distance while continuing relative rotation between the flanging tool and container body to enlarge said flange ring; and ironing said enlarged flange ring by relative rotation between the flanging tool and container body without substantial axial advancement therebetween.

22. The method of claim 21, further comprising separating said container body and flanging tool by opposite relative axial movement while relatively rotating the flanging tool and container body.

23. The method of claim 21, wherein the container body has opposite open ends, comprising:

supporting the cylindrical body between said roll flanging tool and a second roll flanging tool facing the opposite open end of the container body, wherein said container body and both roll flanging tools are rotatable on the central axis of the container body;

simultaneously advancing both flanging tools by said first axial distance in contact, respectively, with the opposite ends of the container body while relatively rotating both of said roll flanging tools in opposite directions with respect to the container body to form said initial flange ring at both ends of the container body;

simultaneously ironing both of said flange rings by rotating both of said flanging tools in opposite directions with respect to the container body while maintaining both roll flanging tools in substantially constant axial position;

simultaneously advancing both flanging tools by said second axial distance while relatively rotating both flanging tools in opposite directions with respect to the container body to form said enlarged flange ring; and simultaneously ironing the enlarged flange ring by rotating both of the flanging tools in opposite directions with respect to the container body without substantial axial movement of the roll flanging tools.

24. The method of claim 23, further comprising: after ironing the enlarged flange ring, simultaneously retracting both of the flanging tool axially from the container body while rotating both of the flanging tools in opposite directions with respect to the container body.

25. The method of claim 23, wherein said flanging tools are rotated in opposite directions with respect to the container body at substantially equal rotational speeds.

* * * * *